US009994386B2

(12) United States Patent
Uno

(10) Patent No.: US 9,994,386 B2
(45) Date of Patent: Jun. 12, 2018

(54) PTP SHEET-GUIDE DEVICE AND TABLET DISPENSER

(71) Applicant: Nakasu Electric Co., Ltd., Seki-shi (JP)

(72) Inventor: Tsuyoshi Uno, Seki (JP)

(73) Assignee: NAKASU ELECTRIC CO., LTD., Seki-shi (JP)

( * ) Notice: Subject to any disclaimer, the term of this patent is extended or adjusted under 35 U.S.C. 154(b) by 0 days. days.

(21) Appl. No.: 14/787,078

(22) PCT Filed: May 13, 2014

(86) PCT No.: PCT/JP2014/002522
§ 371 (c)(1),
(2) Date: Oct. 26, 2015

(87) PCT Pub. No.: WO2014/185058
PCT Pub. Date: Nov. 20, 2014

(65) Prior Publication Data

US 2016/0068329 A1 Mar. 10, 2016

(30) Foreign Application Priority Data

May 14, 2013 (JP) ..... 2013-102364

(51) Int. Cl.
*B65D 83/04* (2006.01)
*A61J 1/03* (2006.01)
*B65B 69/00* (2006.01)

(52) U.S. Cl.
CPC ..... *B65D 83/0409* (2013.01); *A61J 1/03* (2013.01); *B65B 69/0058* (2013.01)

(58) Field of Classification Search
CPC ..... A61J 1/03; A61J 1/035; B65B 69/0058; B65D 83/0409; G07F 11/24
See application file for complete search history.

(56) References Cited

U.S. PATENT DOCUMENTS 6,024,247 A * 2/2000 Birr ..... B65B 69/0058 221/26
6,474,500 B1 * 11/2002 Carr ..... A01C 7/04 221/25

(Continued)

OTHER PUBLICATIONS

Original and English translation of International Search Report for PCT/JP2014/002522, dated Sep. 9, 2014 (4 pages).

*Primary Examiner* — Leslie A Nicholson, III
*Assistant Examiner* — Kelvin L Randall, Jr.
(74) *Attorney, Agent, or Firm* — Shumaker, Loop & Kendrick, LLP

(57) ABSTRACT

Provided are a PTP sheet-guide device which can prevent a tablet from being broken at conveying a PTP sheet according to the shape of the PTP sheet and/or tablet and can stably convey the PTP sheet, and a tablet dispenser. A tablet dispenser of the present invention has a driving roller which is rotatably mounted on a driving shaft, a driven roller which nips a sheet portion of a PTP sheet in cooperation with the driving roller and is rotated following the driving roller to convey the PTP sheet, a pressing roller which is coaxially rotated with either of the driving roller and the driven roller and is arranged so as to be capable of dispensing a tablet by pressing a tablet holding portion at conveying the PTP sheet, and a PTP sheet-guide device having a guide which arranges the PTP sheet thereon and guides the conveying of the PTP sheet. The PTP sheet-guide device has a first interval adjustment mechanism which changes a first interval between the end of the guide and the outer face of the pressing roller.

8 Claims, 17 Drawing Sheets

(56) References Cited

U.S. PATENT DOCUMENTS

| | | | | |
|---|---|---|---|---|
| 8,019,471 | B2 * | 9/2011 | Bogash | G06F 19/3462 700/232 |
| 8,157,125 | B2 * | 4/2012 | Schiff | B65B 69/0058 221/197 |
| 9,387,153 | B1 * | 7/2016 | Mazur | A61J 7/0069 |
| 2008/0257904 | A1 * | 10/2008 | Schiff | B65B 69/0058 221/74 |
| 2014/0241838 | A1 * | 8/2014 | Beck | B65B 69/0058 414/412 |
| 2014/0241839 | A1 * | 8/2014 | Beck | B65B 69/0058 414/412 |
| 2015/0191268 | A1 * | 7/2015 | Paz | A61J 1/035 221/15 |
| 2016/0128903 | A1 * | 5/2016 | Uetake | A61J 1/035 206/531 |
| 2016/0137329 | A1 * | 5/2016 | Langemaat | B65B 69/0058 414/412 |

* cited by examiner

PTP SHEET-GUIDE DEVICE AND TABLET DISPENSER

TECHNICAL FIELD

The present invention relates to a PTP sheet-guide device and a tablet dispenser having the PTP sheet-guide device.

BACKGROUND ART

A tablet dispenser which easily dispenses a tablet in a PTP sheet has been known. The PTP sheet is a sheet which protects the tablet, and is also called a "tablet sheet". The tablet herein is not only in a tablet shape, but also in a capsule shape. The thickness of the tablet, which will be described later, means the thickness in the normal line direction in the plane of the PTP sheet which accommodates the tablet.

A tablet dispenser in Patent Literature 1 has a driving roller which conveys the PTP sheet from the upstream side to the downstream side, a driven roller which is rotated following the rotation of the driving roller a pressing roller which is disposed coaxially with the driving roller and presses a tablet sealing portion of the PTP sheet conveyed by the driving roller and the driven roller and a guide (a pre-conveying supporting portion which places the PTP sheet thereon and conveys the PTP sheet to the rollers. The driving roller and the driven roller have nipping portions for nipping the ends of the PTP sheet (both sides of the tablet sealing portion). The tablet dispenser has a driving roller interval changing mechanism which changes the position of the pressing roller so that the pressing roller is positioned in the middle position between adjacent driving rollers. That is, the tablet dispenser can adjust the position of the pressing roller according to the width of the PTP sheet. In the tablet dispenser, the PTP sheet is placed on the guide, is guided by the guide to the engaging faces of the sheet conveying rollers (the driving roller and the driven roller), and is conveyed by rotating the driving roller and the driven roller. The tablet holding portion of the PTP sheet conveyed (to the engaging faces) is pressed by the pressing roller, and can dispense the tablet from the tablet holding portion.

CITATIONS LIST

Patent Literature 1: Japanese Patent Application Laid-Open (JP-A) No. 2004-131149

SUMMARY OF INVENTION

Typically, in the tablet dispenser, when the end of the guide on the roller side and the engaging faces (or the nipping faces) of the sheet conveying rollers (the driving roller and the driven roller) are excessively separated from each other, the guide cannot sufficiently exhibit the guiding function of conveying the PTP sheet to the rollers, with the result that the PTP sheet cannot be stably conveyed. Thus, the end of the guide and the engaging faces of the sheet conveying rollers is preferably arranged so as to be arranged as close as possible. However, in the conventional tablet dispenser, the distance between the end of the guide and the engaging faces of the sheet conveying rollers cannot be changed, and the thickness (or the height) of the tablet accommodated in the tablet holding portion of the PTP sheet is not considered. That is, when the interval between the end of the guide and the engaging faces of the sheet conveying rollers is reduced in order to obtain the conveying stability of the PTP sheet, the interval between the guide and the pressing roller (which typically has a larger diameter than the sheet conveying rollers) is reduced accordingly, so that when the PTP sheet in which the tablet with a thickness larger than the interval is packed is conveyed, the tablet is accidentally nipped between the guide and the pressing roller and is broken. In particular, there are many types of tablets to be accommodated in the PTP sheet, the tablets having various thicknesses, so that it is necessary to achieve both of the conveying stability of the PTP sheet and tablet breakage prevention according to the shape of the PTP sheet (or the tablet).

The present invention has been made to solve the above problems, and an object of the present invention is to provide a PTP sheet-guide device which can prevent a tablet from being broken at conveying a PTP sheet according to the shape of the PTP sheet and/or tablet and can stably convey the PTP sheet and a tablet dispenser having the PTP sheet-guide device.

A tablet dispenser in a first aspect, which dispenses a tablet from a PTP sheet having a sheet portion and a tablet holding portion includes a driving roller which is rotatably mounted on a driving shaft, a driven roller which nips the sheet portion of the PTP sheet in cooperation with the driving roller and is rotated following the driving roller to convey the PTP sheet, a pressing roller which is coaxially rotated with either of the driving roller and the driven roller and is arranged so as to be capable of dispensing the tablet by pressing the tablet holding portion at conveying the PTP sheet, and a PTP sheet-guide device having a guide which arranges the PTP sheet thereon and guides the conveying of the PTP sheet, in which the PTP sheet-guide device has a first interval adjustment mechanism which changes a first interval between the end of the guide and the outer face of the pressing roller.

In the tablet dispenser in a second aspect, according to the tablet dispenser in the first aspect, the first interval adjustment mechanism can adjust the first interval by moving the guide along the conveying direction of the PTP sheet.

In the tablet dispenser in a third aspect, according to the tablet dispenser in the first or second aspect, the PTP sheet-guide device further has a second interval adjustment mechanism which inhibits the PTP sheet from being arranged on the guide according to the height of the tablet holding portion, the second interval adjustment mechanism having an inhibition portion which extends opposite the guide, being capable of adjusting a second interval between the inhibition portion and the guide, and inhibiting the PTP sheet from being arranged on the guide by abutting the inhibition portion onto the tablet holding portion when the second interval is less than the height of the tablet holding portion.

In the tablet dispenser in a fourth aspect, according to the tablet dispenser in the third aspect, the first interval adjustment mechanism and the second interval adjustment mechanism are operated together so that the first interval and the second interval are substantially matched.

In the tablet dispenser in a fifth aspect, according to the tablet dispenser in any one of the first to fourth aspects, the PTP sheet-guide device has a pair of sideward guides, and the width of the sideward guides and the widthwise positions of the driving roller, the driven roller, and the pressing roller can be adjusted at the same time so as to correspond to the width of the PTP sheet and the position of the tablet holding portion.

A PTP sheet-guide device in a sixth aspect, which is mounted on a tablet dispenser body having a driving roller which is rotatably mounted on a driving shaft, a driven roller which nips a sheet portion of a PTP sheet in cooperation with the driving roller and is rotated following the driving roller to convey the PTP sheet, and a pressing roller which is coaxially rotated with either of the driving roller and the driven roller and is arranged so as to be capable of dispensing a tablet by pressing a tablet holding portion of the PTP sheet at conveying the PTP sheet, the device includes a guide which arranges the PTP sheet thereon and guides the conveying of the PTP sheet to the engaging faces of the driving roller and the driven roller, and a first interval adjustment mechanism which changes a first interval between the end of the guide and the outer face of the pressing roller.

In the PTP sheet-guide device in a seventh aspect, according to the PTP sheet-guide device in the sixth aspect, the first interval adjustment mechanism can adjust the first interval by moving the guide along the conveying direction of the PTP sheet.

The PTP sheet-guide device in an eighth aspect, according to the PTP sheet-guide device in the sixth or seventh aspect, further includes a second interval adjustment mechanism which inhibits the PTP sheet from being arranged on the guide according to the height of the tablet holding portion, the second interval adjustment mechanism having an inhibition portion which extends opposite the guide, being capable of adjusting a second interval between the inhibition portion and the guide, and inhibiting the PTP sheet from being arranged on the guide by abutting the inhibition portion onto the tablet holding portion when the second interval is less than the height of the tablet holding portion.

In the PTP sheet-guide device in a ninth aspect, according to the PTP sheet-guide device in the eighth aspect, the first interval adjustment mechanism and the second interval adjustment mechanism are operated together so that the first interval and the second interval are substantially matched.

The PTP sheet-guide device in a tenth aspect, according to the PTP sheet-guide device in the sixth to ninth aspects, further includes a displaying portion which numerically displays the first interval.

According to the first aspect of the invention, the first interval adjustment mechanism can freely change the first interval between the end of the guide and the outer face of the pressing roller according to the height of the tablet holding portion of the PTP sheet and/or the thickness of the tablet. The first interval is set to a size which is substantially equal to the height of the tablet holding portion of the PTP sheet (or the thickness of the tablet), or to a size which enables the tablet holding portion to be passed to the engaging faces without being brought into contact with the pressing roller on the guide. Thus, the PTP sheet can be passed to the engaging faces (or the nipping faces) of the driving roller and the driven roller so as not to nip the tablet between the pressing roller and the guide at conveying the PTP sheet. The end of the guide can be arranged as close as possible to the engaging faces of the driving roller and the driven roller in the range not breaking the tablet, so that by adjusting the first interval according to the shape of the PTP sheet, the tablet can be prevented from being broken and the conveying stability of the PTP sheet can be appropriately improved. Thus, the tablet dispenser of the present invention can prevent the tablet from being nipped and broken between the guide and the pressing roller by corresponding appropriately to the type of the tablet and stably convey the PTP sheet.

According to the second aspect of the invention, in addition to the effect of the first aspect of the invention, the first interval can be adjusted by the simple mechanism which moves the guide along the conveying direction.

According to the third aspect of the invention, in addition to the effect of the first or second aspect of the invention, when the first interval is less than the height of the tablet holding portion (that is, the thickness of the tablet), the PTP sheet can be inhibited from being arranged on the guide. That is, by adjusting the second interval by the second interval adjustment mechanism so that the second interval is matched with the first interval, the inhibition portion inhibits the PTP sheet which holds the tablet holding portion (or the tablet) larger than the first interval, from being arranged on the guide, thereby preventing the tablet from being broken at arranging the PTP sheet.

According to the fourth aspect of the invention, in addition to the effect of the third aspect of the invention, the first interval adjustment mechanism and the second interval adjustment mechanism are operated together so that the first interval and the second interval are substantially matched, so that simply by operating either of the first interval adjustment mechanism and the second interval adjustment mechanism, both of the first interval and the second interval can be matched with the height of the tablet holding portion of the PTP sheet (or the thickness of the tablet). That is, the first interval and the second interval can be easily optimized at the same time by a single operation.

According to the fifth aspect of the invention, in addition to the effect of any one of the first to fourth aspects of the invention, the width of the sideward guides is adjusted in a state where the PTP sheet is arranged on the guide, and the widthwise positions of the driving roller, the driven roller, and the pressing roller can be easily adjusted so as to be matched with the position of the tablet holding portion.

According to the sixth aspect of the invention, the first interval adjustment mechanism can freely change the first interval between the end of the guide and the outer face of the pressing roller according to the height of the tablet holding portion of the PTP sheet and/or the thickness of the tablet. The first interval is set to a size which is substantially equal to the height of the tablet holding portion of the PTP sheet (or the thickness of the tablet), or to a size which enables the tablet holding portion to reach the engaging faces without being brought into contact with the pressing roller on the guide. Thus, the PTP sheet can be passed to the engaging faces (or the nipping faces) of the driving roller and the driven roller so as not to nip the tablet between the pressing roller and the guide at conveying the PTP sheet. The guide can be arranged as close as possible to the engaging faces of the driving roller and the driven roller in the range not breaking the tablet, so that by adjusting the first interval according to the shape of the PTP sheet, the tablet can be prevented from being broken and the conveying stability of the PTP sheet can be improved. Thus, the PTP sheet-guide device of the present invention, which is mounted on the tablet dispenser, can prevent the tablet from being nipped and broken between the guide and the pressing roller by corresponding appropriately to the type of the tablet and stably convey the PTP sheet.

According to the seventh aspect of the invention, in addition to the effect of the sixth aspect of the invention, the first interval can be adjusted by the simple mechanism which moves the guide along the conveying direction.

According to the eighth aspect of the invention, in addition to the effect of the sixth or seventh aspect of the invention, when the first interval is less than the height of the tablet holding portion (that is, the thickness of the tablet), the PTP sheet can be inhibited from being arranged on the guide.

That is, by adjusting the second interval by the second interval adjustment mechanism so that the second interval is matched with the first interval, the inhibition portion inhibits the PTP sheet which holds the tablet holding portion (or the tablet) larger than the first interval, from being arranged on the guide, thereby preventing the tablet from being broken at arranging the PTP sheet.

According to the ninth aspect of the invention, in addition to the effect of the eighth aspect of the invention, the first interval adjustment mechanism and the second interval adjustment mechanism are operated together so that the first interval and the second interval are substantially matched, so that simply by operating either of the first interval adjustment mechanism and the second interval adjustment mechanism, both of the first interval and the second interval can be matched with the height of the tablet holding portion of the PTP sheet (or the thickness of the tablet). That is, the first interval and the second interval can be easily optimized at the same time by a single operation.

According to the tenth aspect of the invention, in addition to the effects of the sixth to ninth aspects of the invention, since the first interval can be adjusted while being visually checked, the first interval can be changed more reliably according to the specifications of the PTP sheet.

BRIEF DESCRIPTION OF DRAWINGS

FIG. 5(*b*) is a cross-sectional view taken along line B-B of the tablet dispenser in FIG. 4.

FIG. 5(*c*) is a cross-sectional view taken along line C-C of the tablet dispenser in FIG. 4.

FIG. 13(*b*) is a cross-sectional view of the PTP sheet.

DESCRIPTION OF EMBODIMENTS

Figure 1:
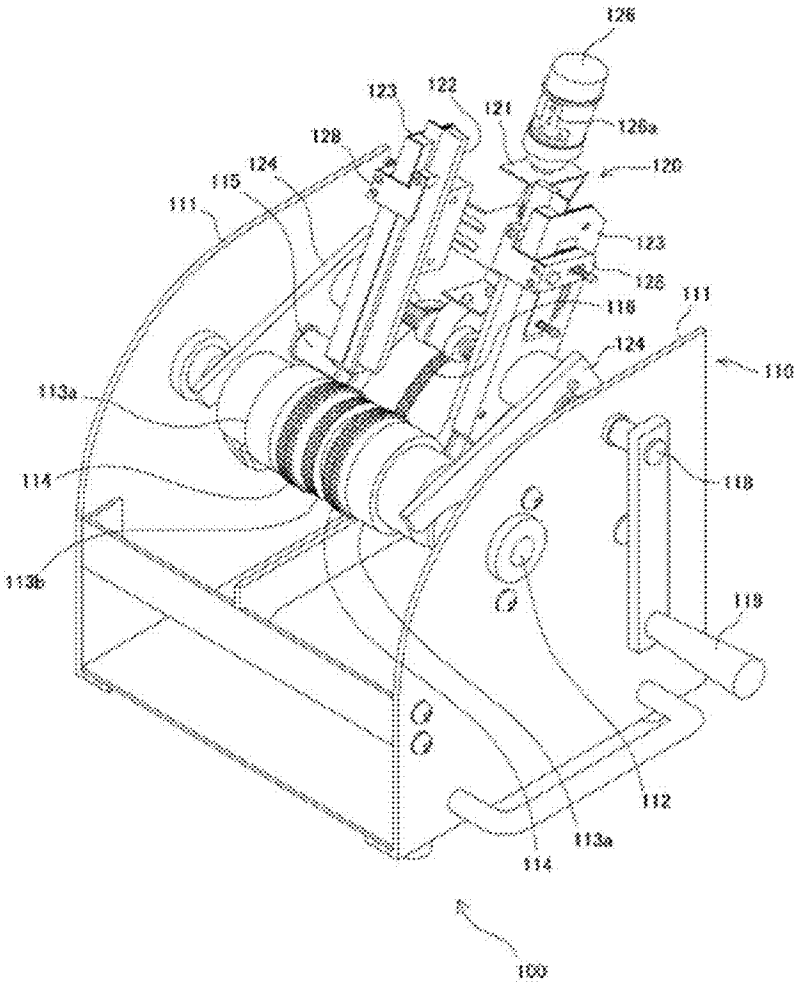
FIG. 1 is a perspective view of a tablet dispenser of an embodiment of the present invention.
Figure 2:
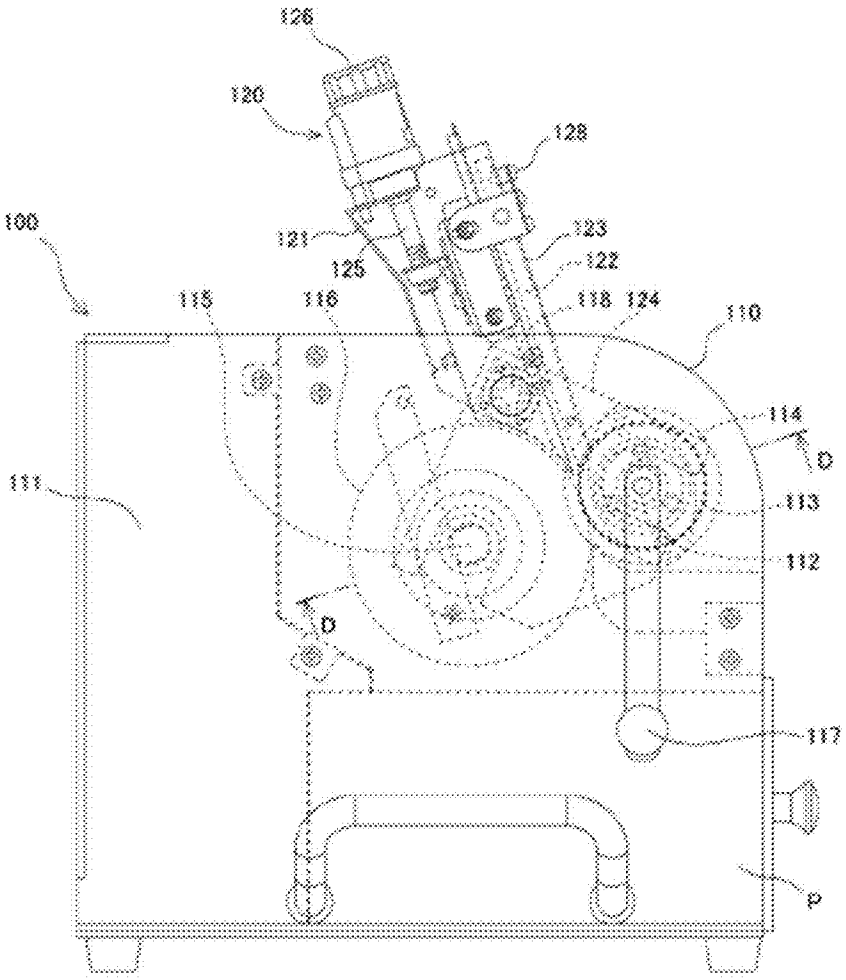
FIG. 2 is a side view of the tablet dispenser in FIG. 1.
Figure 3:
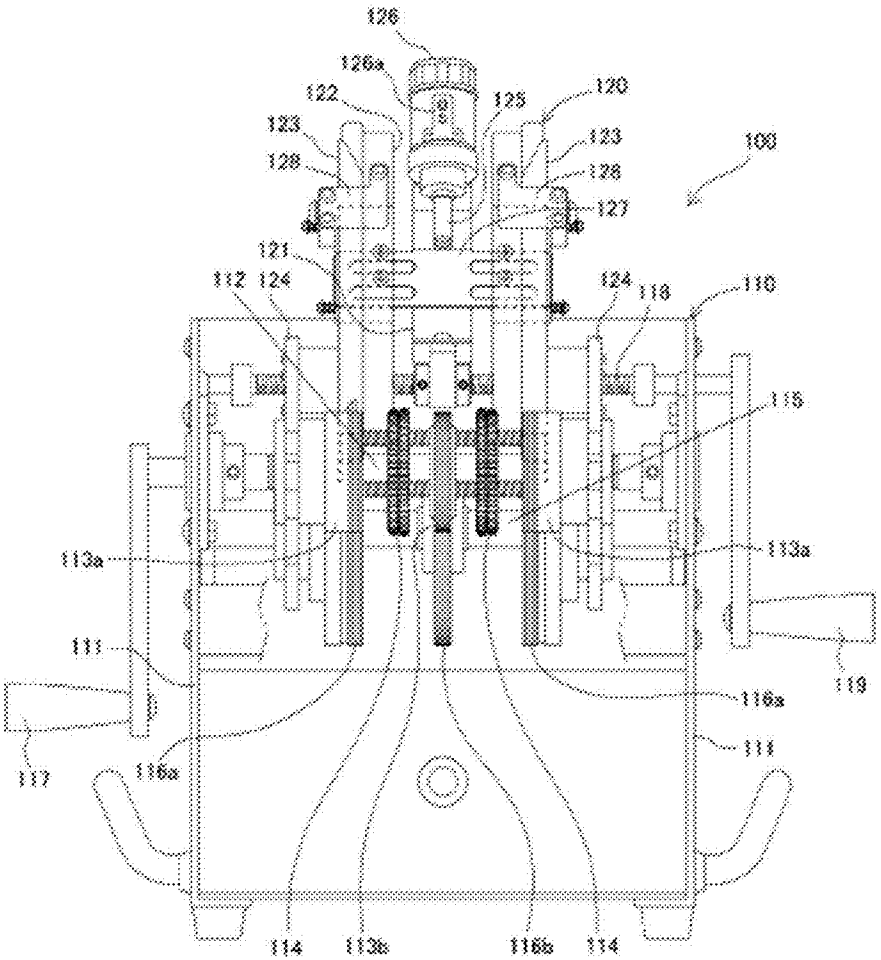
FIG. 3 is a front view of the tablet dispenser in FIG. 1.
Figure 4:
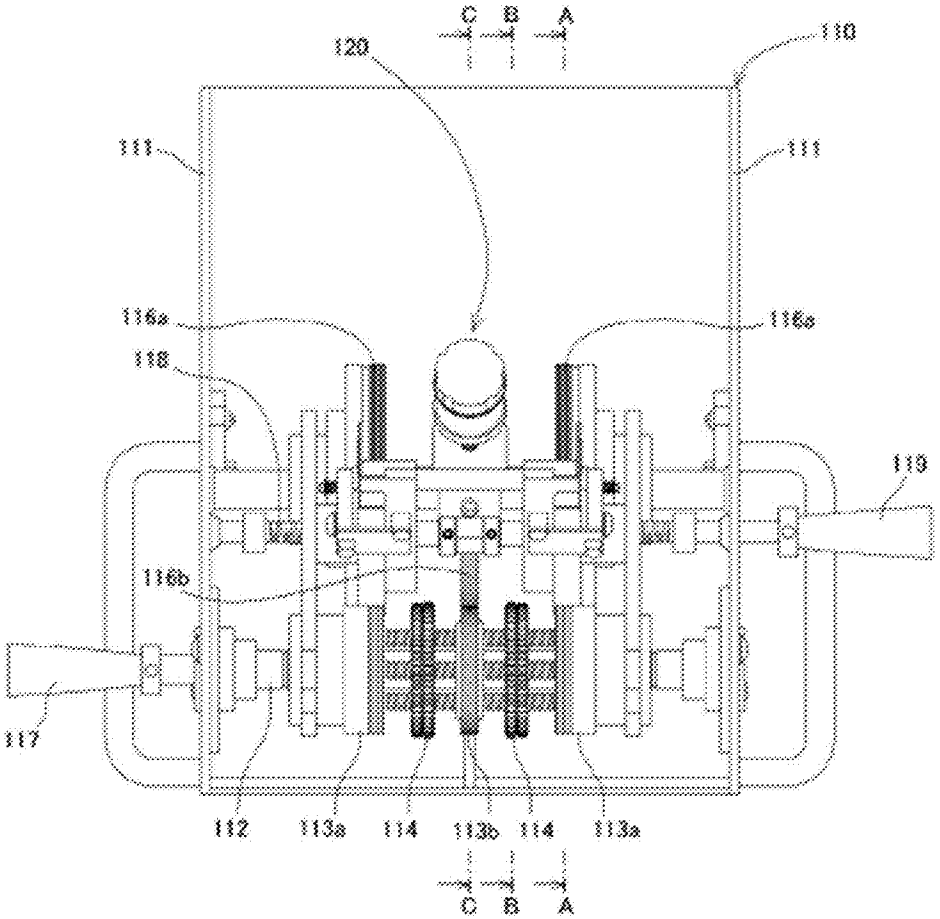
FIG. 4 is a plan view of the tablet dispenser in FIG. 1.

Hereinafter, an embodiment of the present invention will be described with reference to the drawings. The drawings referred in the following description are concept diagrams or schematic diagrams in describing preferable shapes, and the dimension ratios are not always matched with the actual ones. That is, the present invention is not limited to the dimension ratios in the drawings.

FIG. 1 is a perspective view of a tablet dispenser 100 of an embodiment of the present invention. The tablet dispenser 100 has a tablet dispenser body 110, and a PTP sheet-guide device 120. FIGS. 2 to 6 are a front view, a side view, a front view, a plan view, and cross-sectional views of the tablet dispenser 100, respectively. The tablet dispenser 100 will be described in more detail with reference to FIGS. 1 to 6.

As illustrated in FIGS. 1 to 4, the tablet dispenser 100 has the tablet dispenser body 110, and the PTP sheet-guide device 120 mounted on the tablet dispenser body 110. The tablet dispenser body 110 has a pair of body side plates 111, a driving shaft 112 which is turnably axially supported on the pair of body side plates 111, a plurality of (three, in this embodiment), driving rollers 113 (113*a*, 113*b*) which are rotatably arranged about the driving shaft 112, a plurality of (two, in this embodiment), pressing rollers 114 which are arranged coaxially with the plurality of driving rollers 113, a driven shaft 115 which is axially supported on the pair of body side plates 111 and is positioned behind the driving rollers 113 so as to be separated from the driving rollers 113 at a predetermined distance, and a plurality of driven rollers 116 (116*a*, 116*b*) which are arranged rotatably about the driven shaft 115 and are rotated following the driving rollers 113. Each driving roller 113 and each driven roller 116 have an engaging face (or a nipping face) at the position of the largest diameter thereof, and function as PTP sheet conveying rollers in cooperation with each other. The driving shaft 112 is connected to a driving handle 117 as driving means at one end thereof. By operating the driving handle 117, the driving rollers 113, the pressing rollers 114, and the driven rollers 116 can be rotated.

Figures 5A, 5B, 5C:
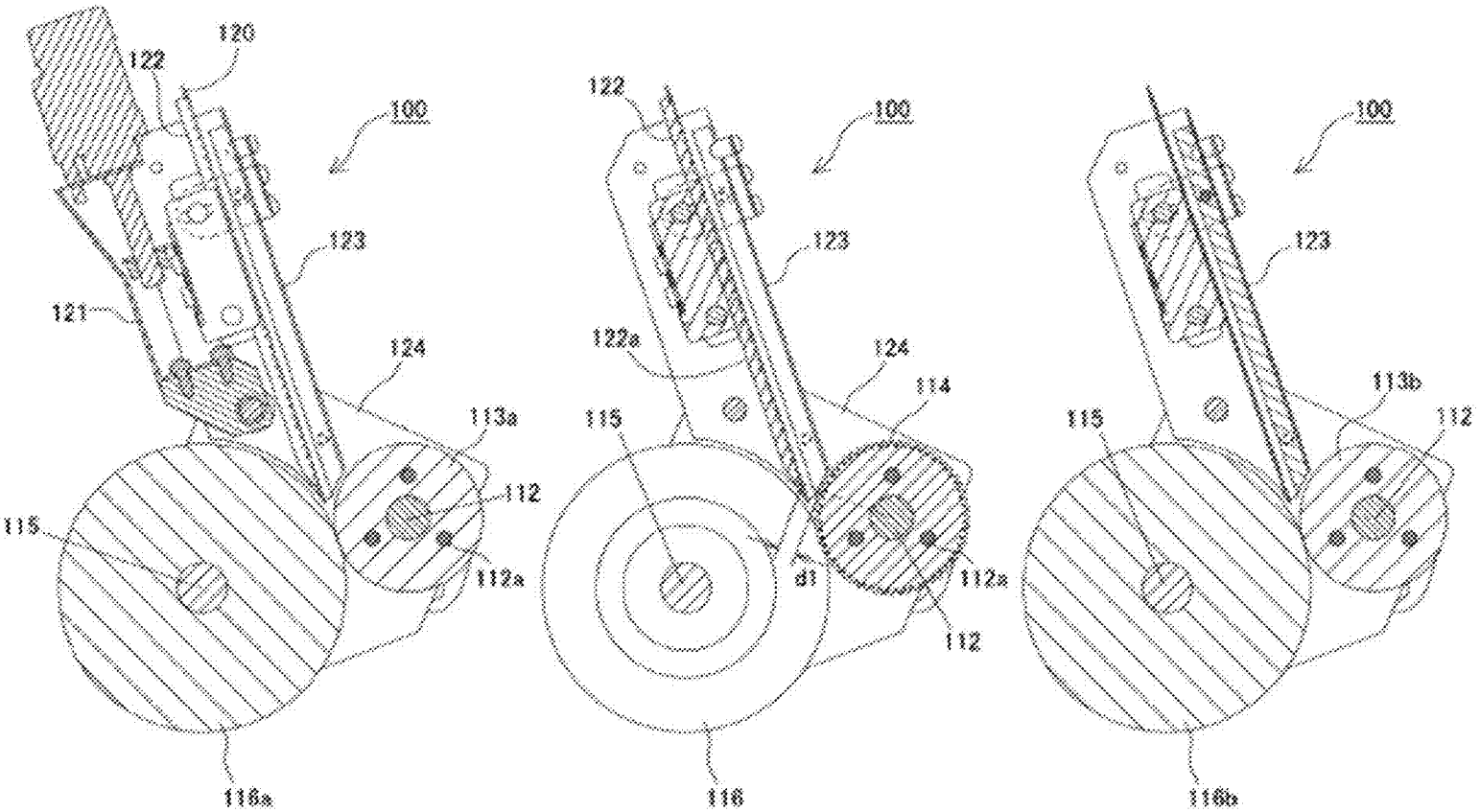
FIG. 5(*a*) is a cross-sectional view taken along line A-A of the tablet dispenser in FIG. 4.
Figure 6:
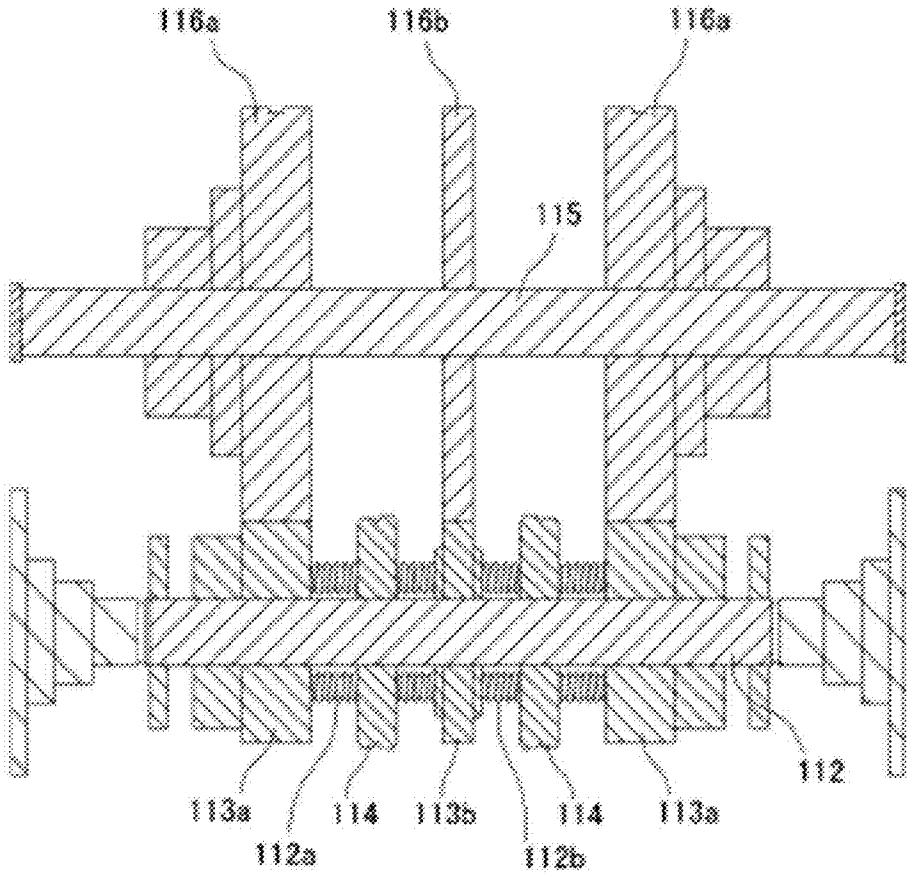
FIG. 6 is a cross-sectional view taken along line D-D of the tablet dispenser in FIG. 2.

FIGS. 5(*a*) to 5(*c*) and FIG. 6 are cross-sectional views of the tablet dispenser 100, and illustrate the positions and the engaging relations of the rollers more clearly. As illustrated in FIGS. 5(*a*) to 5(*c*) and FIG. 6, the driving rollers 113 have the two outside driving rollers 113*a*, and the center driving roller 113*b*. The driving rollers 113*a*, 113*b* have a substantially equal outside diameter. The outside driving rollers 113*a* are arranged movably along the driving shaft 112, and the center driving roller 113*b* is fixed to the center of the driving shaft 112. Each of the two pressing rollers 114 which are arranged coaxially with the driving rollers 113 is positioned in the substantially middle position between the adjacent driving rollers 113 (that is, between each outside driving roller 113*a* and the center driving roller 113*b*). Each pressing roller 114 is connected to the driving rollers 113 by a plurality of connection shafts 112*a* so as to be synchronously rotatable with the driving rollers 113. Each pressing roller 114 is biased from both sides by springs 112*b* mounted on the connection shafts 112*a*. That is, even when each outside driving roller 113*a* is moved along the driving shaft 112, each pressing roller 114 is always maintained in the middle position between the center driving roller 113*b* and the outside driving roller 113*a*. The pressing rollers 114 have a larger outside diameter than the driving rollers 113, and a pressing face (or a contacting face) in an uneven shape which can easily press a tablet holding portion of a PTP sheet. The connection mechanism of the driving rollers 113 and the pressing rollers 114 is disclosed in detail in Japanese Patent Application Laid-Open (JP-A) No. 2010-136980.

The driven rollers 116 have the two outside driven rollers 116*a*, and the center driven roller 116*b*. The widthwise position of each outside driven roller 116*a* coincides with the widthwise position of each outside driving roller 113*a*, and the widthwise position of the driven roller 116*b* coincides with the widthwise position of the driving roller 113*b*. The driven rollers 116 are directly engaged with the driving rollers 113, or are indirectly engaged with the driving rollers 113 through the PTP sheet, and can be rotated following the driving rollers 113 being rotated. In the driven rollers 116, the outside driven rollers 116*a* are arranged movably along the driven shaft 115, and the center driven roller 116*b* is fixed to the substantially center of the driven shaft 115. The outside driven rollers 116*a* can be moved at an equal interval together with the outside driving rollers 113*a* by a width adjustment mechanism described later.

Further, the tablet dispenser body 110 has the width adjustment mechanism which moves the driving rollers 113 and the pressing rollers 114 widthwise along the driving shaft 112, and moves the driven rollers 116 widthwise along the driven shaft 115. The width adjustment mechanism has a width adjustment shaft 118 which is arranged to be parallel with the driving shaft 112 and the driven shaft 115 and is axially supported on the pair of body side plates 111, a width adjustment handle 119 which is connected to one end of the width adjustment shaft 118, and a pair of connection portions 124 (being capable of being interpreted as part of the PTP sheet-guide device 120) which are screw-mounted on the width adjustment shaft 118 and connect the outside driving rollers 113*a* and the outside driven rollers 116*a*.

In the width adjustment mechanism, the width adjustment shaft 118 is threaded in at least part thereof, and is axially rotated by the width adjustment handle 119, and the pair of connection portions 124 screw-mounted on the width adjustment shaft 118 are moved in the approaching/separating direction. With the moving of the pair of connection portions 124, the outside driving rollers 113*a* and the outside driven rollers 116*a* are moved widthwise.

Figure 7:
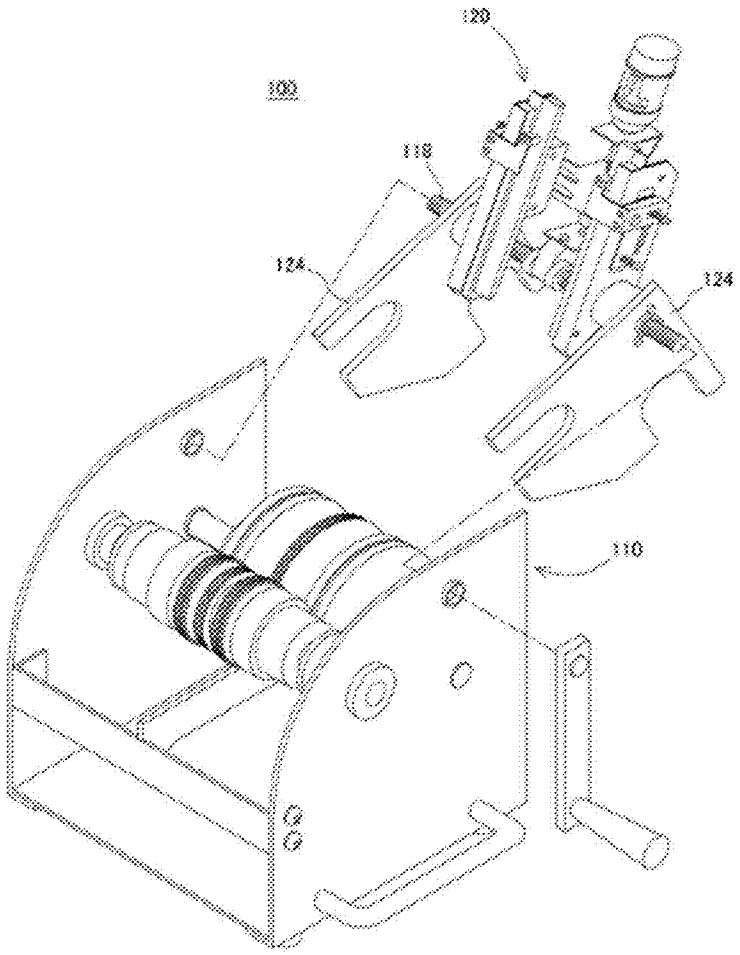
FIG. 7 is an exploded perspective view of the tablet dispenser in FIG. 1.

As illustrated in the exploded perspective view of the tablet dispenser 100 in FIG. 7, the PTP sheet-guide device 120 of an embodiment of the present invention has the pair of connection portions 124, and is connected to the tablet dispenser body 110 through the pair of connection portions 124 and the width adjustment shaft 118.

Figure 8:
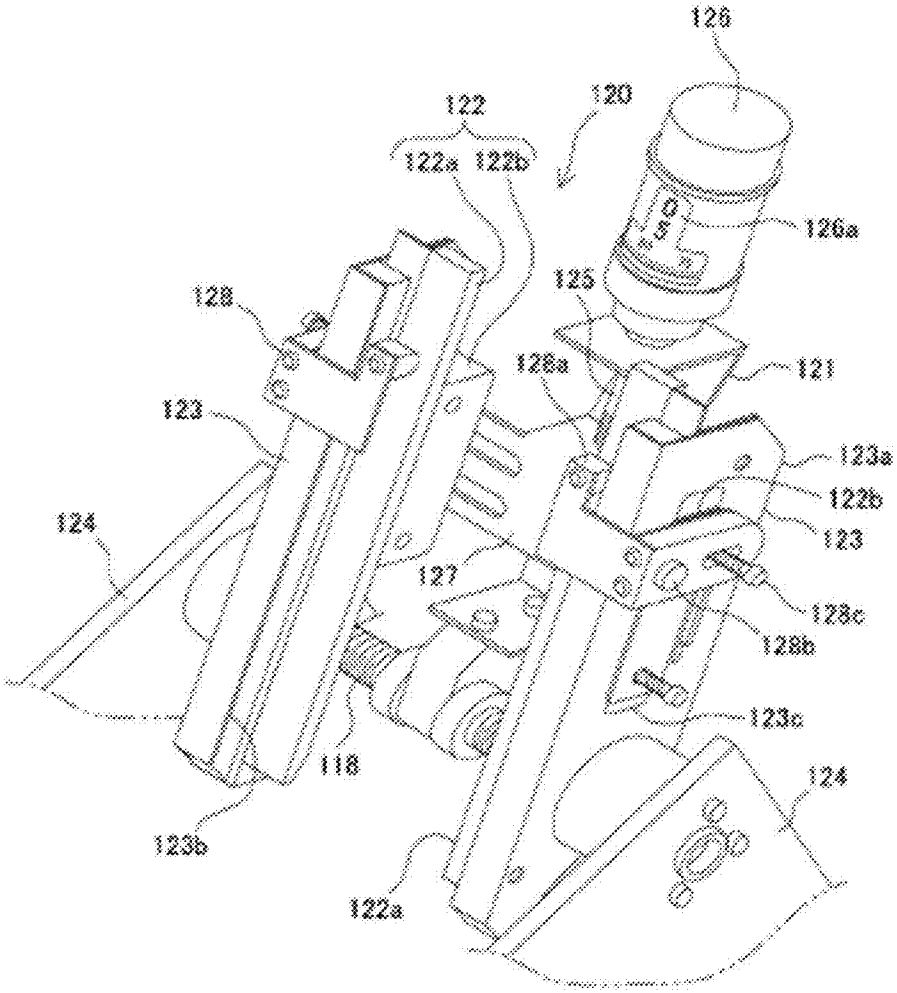
FIG. 8 is a perspective view of a PTP sheet-guide device of an embodiment of the present invention.
Figure 9:
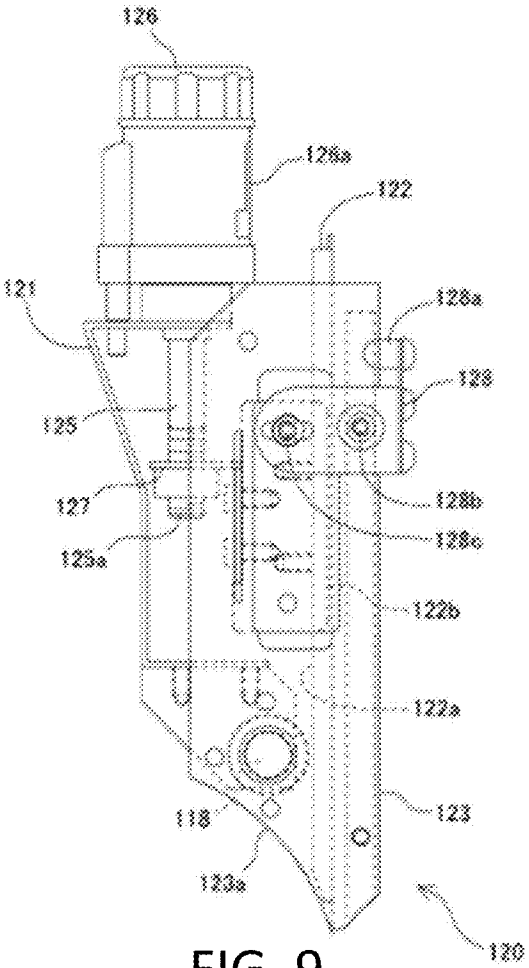
FIG. 9 is a side view of the PTP sheet-guide device in FIG. 8.
Figure 10:
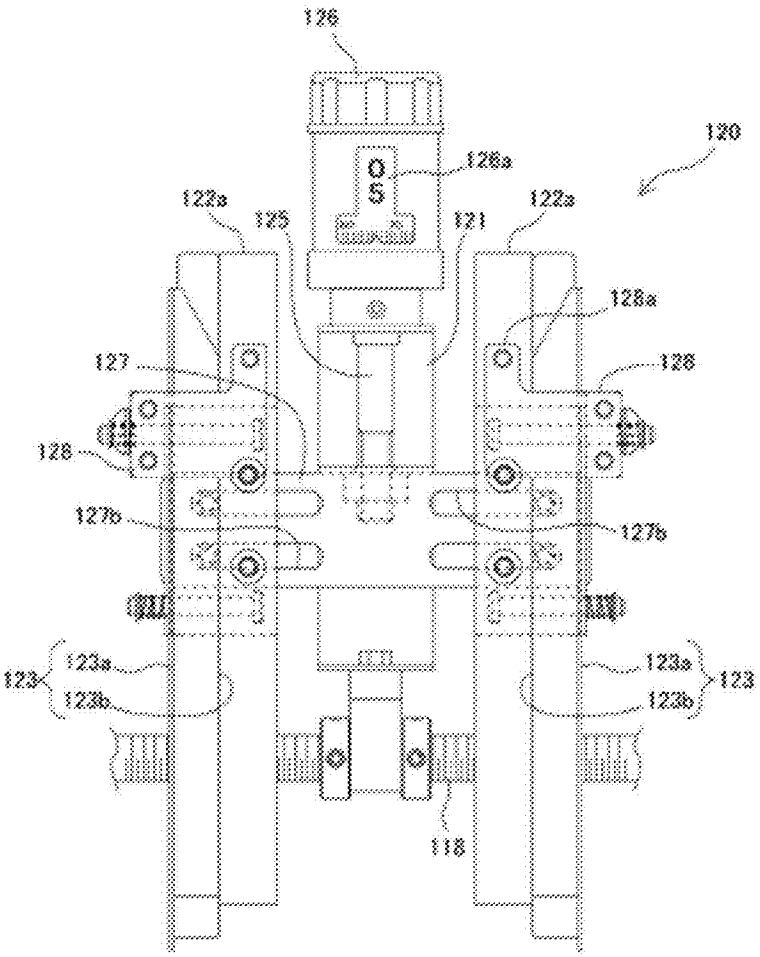
FIG. 10 is a front view of the PTP sheet-guide device in FIG. 8.

FIGS. 8 to 10 are a perspective view, a side view, and a front view of the PTP sheet-guide device 120 of an embodiment of the present invention, respectively. The PTP sheet-guide device 120 will be described below in detail with reference to FIGS. 8 to 10.

The PTP sheet-guide device 120 has a base 121 which is fixed to the substantially center of the width adjustment shaft 118, guides 122 which are arranged in front of the base 121 and place the PTP sheet thereon, a pair of sideward guides 123 which are arranged along the guides 122 and have a longitudinal shape projecting to the front in the substantially perpendicular direction thereof, and the pair of connection portions 124 which are connected to the outer sides of the pair of sideward guides 123.

Each guide 122 has a guide plate 122*a* in a long plate shape, and a rectangular connection body 122*b* which is connected to the back side of the guide plate 122*a*. Each guide 122 has a front face which extends in substantially parallel with the engaging faces of each driving roller 113 and each driven roller 116 (or a face on which the PTP sheet is placed). Thus, the PTP sheet can be stably conveyed to the engaging faces (or the nipping faces) of each driving roller 113 and each driven roller 116. As illustrated in FIG. 5(*b*), the end in the conveying direction (or the lower end) of each guide 122 is arranged so as to be separated from the pressing face of each pressing roller 114 at predetermined first interval d1 (or to be closer to the pressing face of the pressing roller 114 than to each driving roller 113). Note that first interval d1 of this embodiment is the shortest distance between the end of the guide plate 122*a* of each guide 122 and the outer face of each pressing roller 114, and is an interval on a line which connects the center of the pressing roller 114 to the end of the guide plate 112*a*.

Each sideward guide 123 has a side plate 123*a*, and a flange 123*b* which extends opposite the guide plate 122*a* of each guide 122. The pair of right and left sideward guides 123 are connected at the side plates 123*a* to the pair of connection portions 124. The guides 122 and the sideward guides 123 are axially supported on the width adjustment shaft 118 so as to be movable along the width adjustment shaft 118, and are operated together with the connection portions 124 moved on the width adjustment shaft 118. That is, by operating the width adjustment handle 119, the pair of sideward guides 123 are moved together with the connection portions 124 on the width adjustment shaft 118 in the approaching/separating direction, so that width w between the pair of sideward guides 123 can be changed. As described above, since the connection portions 124 connect the sideward guides 123, the driving rollers 113, and the driven rollers 116, with the adjustment of width w between the sideward guides 123, the widthwise positions of the rollers can be changed. The width adjustment mechanism applicable to this embodiment is also described in detail in JP-A No. 2004-131149.

An interval adjustment shaft 125, which extends in the up/down direction in a state of being slightly tilted in the front/rear direction, is held on the base 121 in an axially rotatable state. The interval adjustment shaft 125 is axially rotatable by an operation portion 126 which is connected at the upper end thereof. Further, the operation portion 126 has a displaying portion 126*a* which measures the rotation amount of the interval adjustment shaft 125 and quantitatively displays first interval d1 (or second interval d2) corresponding to the moving amount of a moving body 127 described later. In this embodiment, as the operation portion 126, "Control Knob DK04" by SIKO is adopted.

The interval adjustment shaft 125 has a screw 125*a* on the lower end side thereof, and the moving body 127 is screw-mounted with the screw 125*a* (through a screw hole 127*a* opened in the upper face thereof). The moving body 127 is movable in the up/down direction along the interval adjustment shaft 125 by the axial rotation of the interval adjustment shaft 125. That is, by operating the operation portion 126 based on the value of the displaying portion 126*a*, the moving body 127 can be moved in the up/down direction at a predetermined distance. The moving body 127 has long holes 127*b* which are opened in the front face thereof and support the guides 122 through the connection bodies 122*b*. The guides 122 are movable along the long holes 127*b*. The sideward guides 123, which are fixed to the connection portions 124, cannot be moved in the conveying direction (or in the up/down direction) of the PTP sheet. That is, the guides 122 can be slid relative to the sideward guides 123 with the moving of the moving body 127.

A pair of inhibition portions 128, which inhibit the PTP sheet from being arranged (or placed) on the guides 122, are connected to the outer sides of the connection bodies 122*b* of the guides 122 (or to the side plates 123*a* of the sideward guides 123). Each inhibition portion 128 has a locking piece 128*a* which has an abutting face curved in a substantially semi-circular shape, a first turning shaft 128*b* which is axially supported at each sideward guide 123 (fixed in the up/down direction), and a second turning shaft 128*c* which is axially supported at each guide 122 (or each connection body 122*b*) (movable with the moving body 127).

Each inhibition portion 128 extends opposite each guide 122, and each locking piece 128*a* is positioned so as to coincide with the widthwise position of the tablet holding portion of the PTP sheet. In other words, in the roller widthwise position relation, the positions of each locking piece 128*a*, each pressing roller 114, and the tablet holding portion are matched. Each inhibition portion 128 is connected to each guide 122 and each sideward guide 123, and can be moved sideward by the width adjustment mechanism. The second interval between the abutting face of each locking piece 128*a* and the front face of each guide 122 is defined as d2. As described later, first interval d1 and second interval d2 are preferably set to be substantially equal.

Each inhibition portion 128 is turnably axially supported at both of each sideward guide 123 and the moving body 127 by two shafts of each first turning shaft 128*b* and each second turning shaft 128*c*. That is, when the moving body 127 is moved in the up/down direction by the operation of the operation portion 126, the rear end of each inhibition portion 128 (or the end on each second turning shaft 128*c* side) is turned in the up/down direction together with the second turning shaft 128*c* about each first turning shaft 128*b* fixed. That is, each first turning shaft 128*b* is operated in conjunction with each second turning shaft 128*c* by the moving of the moving body 127, and the locking piece 128*a* of each inhibition portion 128 is turned in the direction approaching or separating from the front face of each guide 122.

Figure 11:
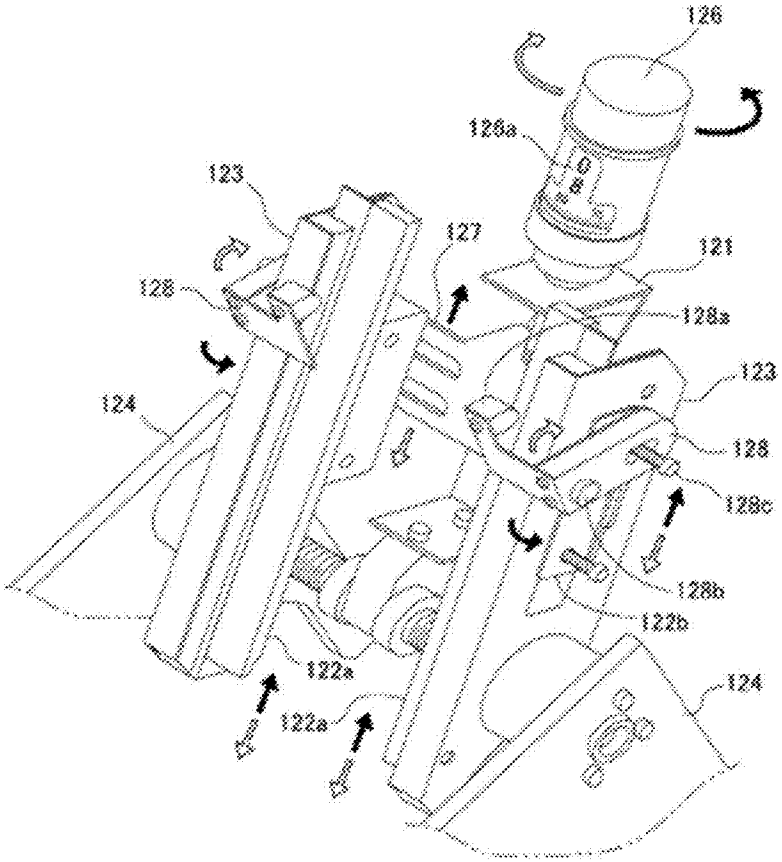
FIG. 11 is an operation view of the PTP sheet-guide device in FIG. 8.

FIG. 11 is a schematic diagram illustrating the operation mode of the PTP sheet-guide device 120 in a case where first interval d1 and second interval d2 are adjusted by (first and second) interval adjustment mechanisms. As illustrated in FIG. 11, by rotating the operation portion 126, the moving body 127 is moved in the up/down direction along the interval adjustment shaft 125. With the moving of the moving body 127, the guides 122 are moved in the up/down direction, thereby changing first interval d1 between the ends of the guides 122 and the outer faces of the pressing rollers 114. At the same time, with the moving of the moving body 127, the inhibition portions 128 are turned about the first turning shafts 128*b*, thereby changing second interval d2 between the abutting faces of the locking pieces 128*a* and the front faces of the guides 122. That is, by operating the operation portion 126, the guides 122 and the inhibition portions 128 are operated together, thereby being capable of changing first interval d1 and second interval d2 at the same time. In this embodiment, first interval d1 and second interval d2 are set to be substantially equal, and can be easily matched with the height of the tablet holding portion (or the thickness of the tablet). That is, in this embodiment, the (first and second) interval adjustment mechanisms are not any specific members, are assumed as mechanisms which are integrally formed so as to be operated together for adjusting first interval d1 and second interval d2 at the same time, and operate the component elements of the PTP sheet-guide device 120 in cooperation with each other.

More specifically, by rotating the operation portion 126 clockwise (viewed from the front) (or in the direction indicated by the white arrow), the moving body 127 can be moved in the down direction. With the moving of the moving body 127 in the down direction, the guides 122 are moved in the down direction (or in the direction indicated by the white arrow) to decrease first interval d1, and the inhibition portions 128 are turned (in the direction indicated by the white arrow) so that the locking pieces 128*a* of the inhibition portions 128 approach the guide plates 122 of the guides 122, thereby decreasing second interval d2. By rotating the operation portion 126 counterclockwise (or in the direction indicated by the black arrow), the moving body 127 can be moved in the up direction. With the moving of the moving body 127 in the up direction, the guides 122 are moved in the up direction (or in the direction indicated by the black arrow) to increase first interval d1, and the inhibition portions 128 are turned (in the direction indicated by the black arrow) so that the locking pieces 128*a* of the inhibition portions 128 are separated from the guide plates 122*a* of the guides 122, thereby increasing second interval d2. In the PTP sheet-guide device 120, the direction of the screw 125*a* of the interval adjustment shaft 125 is designed so that the interval is narrowed when the operation portion 126 is rotated clockwise according to the viewpoint of human engineering. That is, in the PTP sheet-guide device 120 of this embodiment, the intuitive usability for the user is considered.

In this embodiment, the positions of the locking piece 128*a*, the first turning shafts 128*b*, and the second turning shafts 128*c* of the inhibition portions 128 are designed so that the shift amounts of first interval d1 and second interval d2 are equal. That is, since the interval between each locking piece 128*a* and each first turning shaft 128*b* and the interval between each first turning shaft 128*b* and each second turning shaft 128*c* are substantially equal, the turning amounts of the locking piece 128*a* and the first turning shaft 128*b* are substantially equal. Further, the abutting face of each locking piece 128*a* in a semi-circular curved shape can be reliably abutted onto the object (tablet holding portion) without depending on the tilting of each inhibition portion 128.

Figure 12:
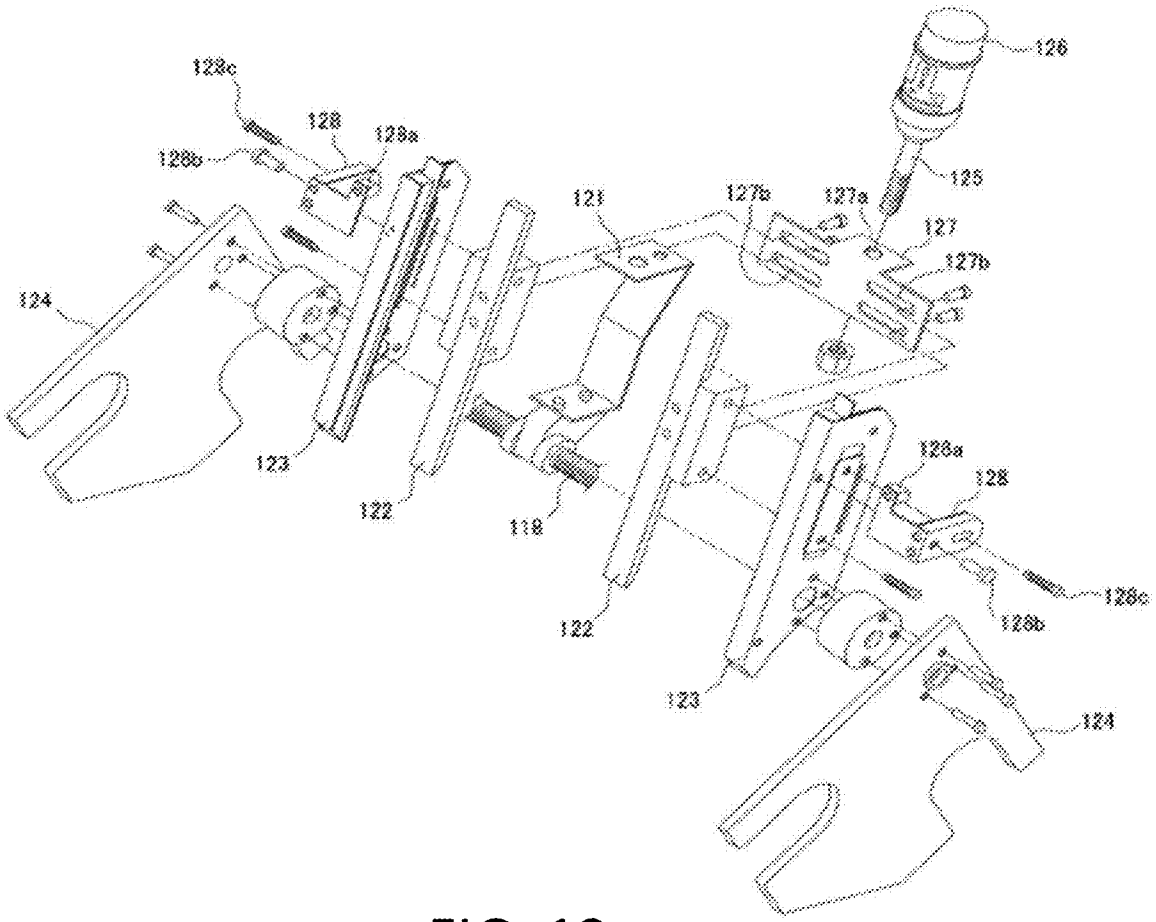
FIG. 12 is an exploded perspective view of the PTP sheet-guide device in FIG. 8.

FIG. 12 is an exploded perspective view of the PTP sheet-guide device 120 of this embodiment. As illustrated in FIG. 12, in the PTP sheet-guide device 120, the assembling body of the interval adjustment shaft 125 and the operation portion 126 is mounted onto the base 121 which is fixed to the center of the width adjustment shaft 118, the moving body 127 is screw-mounted on the interval adjustment shaft 125, and the guides 122 are mounted in the long holes 127*b* of the moving body 127 so as to be shiftable widthwise through the connection bodies 122*b*. The sideward guides 123 fixed to the connection portions 124 are arranged adjacent to the side faces of the guides 122, and the connection bodies 122*b* are arranged in side holes 123*c* of the sideward guides 123. The inhibition portions 128 are connected to the guides 122 and the sideward guides 123 through the first turning shafts 128*b* and the second turning shafts 128*c*, thereby assembling the PTP sheet-guide device 120.

A process for dispensing tablet T from PTP sheet S by the tablet dispenser 100 of this embodiment will be described.

Figure 13B:
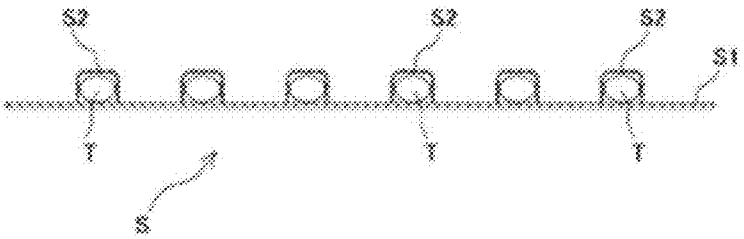
FIG. 13(*a*) is a perspective view of a PTP sheet.
Figure 13A:
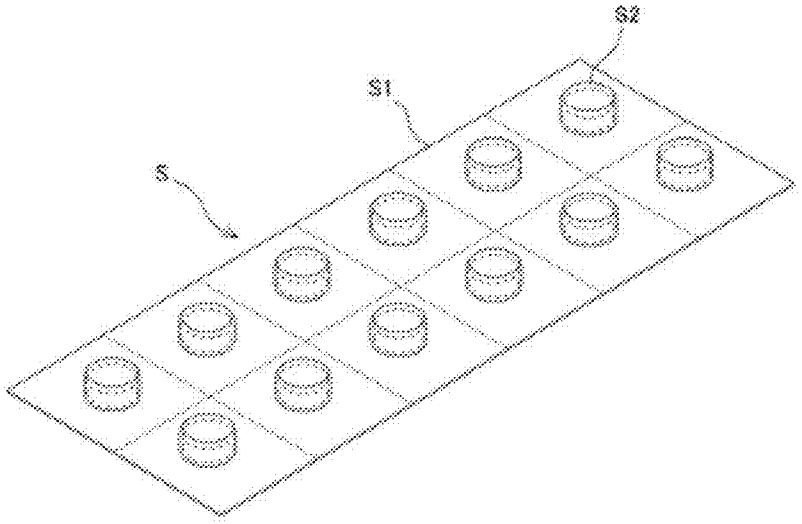

FIGS. 13(*a*) and 13(*b*) are a perspective view and a cross-sectional view of PTP sheet S, respectively. PTP sheet S has sheet portion S1, and tablet holding portion S2 holding tablet T therein. An aluminum foil is stuck onto the back side of sheet portion S1 of PTP sheet S, and tablet T is sealed in tablet holding portion S2. Tablet holding portion S2 is formed of a flexible material (synthetic resin), and has height h. Tablet holding portion S2 is pressed from the surface thereof and is recessed, the aluminum foil is torn, and tablet T can be dispensed from tablet holding portion S2. Typically, height h is designed so as to correspond to the thickness of tablet T so that tablet T is not rattled in tablet holding portion S2.

First, the lateral width of PTP sheet S and width w between the side plates 123*a* of the sideward guides 123 are adjusted to be matched. By turning the width adjustment handle 119, the connection portions 124 are moved widthwise, so that the sideward guides 123, the outside driving rollers 113*a*, the pressing rollers 114, and the outside driven rollers 116*a* are operated together and are moved widthwise. The sideward guides 123 and the outside driving rollers 113*a* (and the outside driven rollers 116*a*) are moved together so as to be matched widthwise. Following this, each pressing roller 114 is moved so as to be positioned in the middle position between each outside driving roller 113*a* and the center driving roller 113*b*. That is, since tablet holding portion S2 of PTP sheet S is positioned in the middle position between the widthwise center line and each side plate 123*a*, the lateral width of PTP sheet S and width w are matched, so that the positions of each pressing roller 114 and tablet holding portion S2 can be substantially matched widthwise. In some cases, width w may be adjusted in a state where PTP sheet S is placed on the guide plates 122*a*.

After width w has been adjusted by the width adjustment mechanism, PTP sheet S is arranged on the guides 122. When PTP sheet S is attempted to be arranged from the front sides of the guides 122, sheet portion S1 is abutted onto the flanges 123*b* of the sideward guides 123, so that PTP sheet S is arranged so as to be inserted into between the guide plates 122*a* and the flanges 123*b* from the upper ends of the guides 122.

Figure 14:
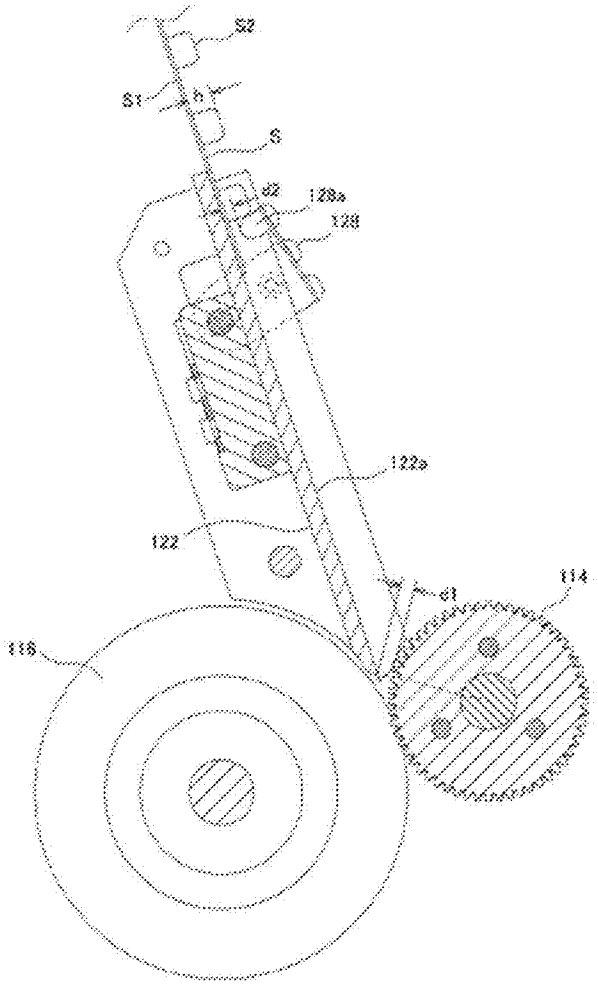
FIG. 14 is a schematic diagram illustrating a step of dispensing a tablet from the PTP sheet by the PTP sheet-guide device in FIG. 1.

As illustrated in FIG. 14, it is assumed that the device is set so that second interval d2 is less than the height of tablet holding portion S2 in the initial state of the PTP sheet-guide device 120. When, in this state, PTP sheet S is arranged on each guide 122, tablet holding portion S2 is stopped by the locking piece 128*a* of each inhibition portion 128, so that PTP sheet S cannot be arranged on the guide 122. At this time, first interval d1 (=d2) between the end of the guide plate 122*a* and the outer face of each pressing roller 114 is less than height h of tablet holding portion S2, and tablet T can be nipped between the guide plate 122*a* and the pressing roller 114 and be broken. That is, when tablet T can be broken, the inhibition portion 128 inhibits PTP sheet S1 from being arranged on the guide 122.

Figure 15:
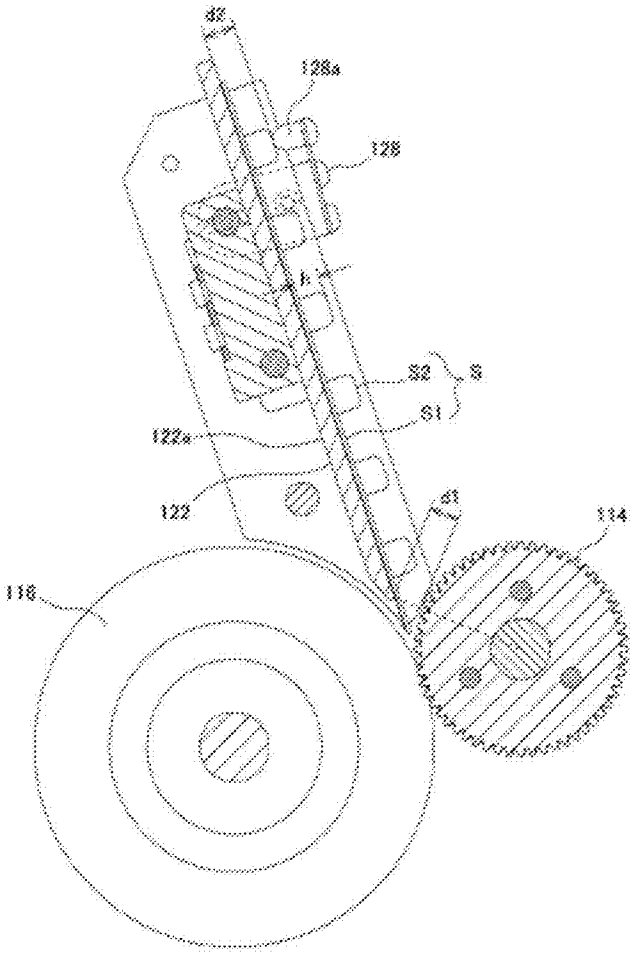
FIG. 15 is a schematic diagram illustrating a step of dispensing the tablet from the PTP sheet by the PTP sheet-guide device in FIG. 1.
Figure 16:
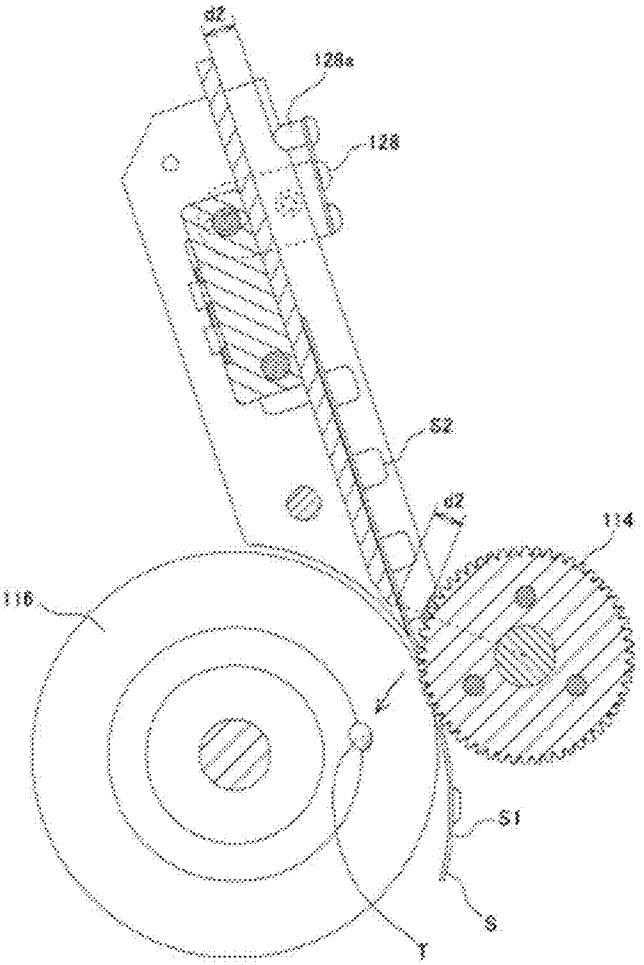
FIG. 16 is a schematic diagram illustrating a step of dispensing the tablet from the PTP sheet by the PTP sheet-guide device in FIG. 1.

The operation portion 126 is rotated while the displaying portion 126*a* is visually checked, second interval d2 is matched with height h of tablet holding portion S2, and tablet holding portion S2 can be arranged on the guide 122 without being inhibited by the inhibition portion 128 (see FIG. 15). At this time, first interval d1 (=d2) is substantially equal to height h of tablet holding portion S2, tablet holding portion S2 can be conveyed together with sheet portion S1 of PTP sheet S to the engaging faces of the driving rollers 113 and the driven rollers 116, without nipping tablet holding portion S2 between the pressing roller 114 and the guide plate 122*a* (see FIG. 16).

Subsequently, the driving handle 117 is further rotated, the driven rollers 116 are rotated following the rotation of the driving rollers 113 while sheet portion S1 of PTP sheet S is nipped between the driving rollers 113 and the driven rollers 116, and PTP sheet S is conveyed in the down direction. In that case, in a state where sheet portion S1 of PTP sheet S is nipped and tensioned between the driving rollers 113 and the driven rollers 116, the pressing roller 114 is pressed onto tablet holding portion S2. With this, the pressing roller 114 presses tablet holding portion S2 at an appropriate position, the aluminum foil stuck onto tablet holding portion S2 is torn, and tablet T is dropped from tablet holding portion S2 into case P (see FIG. 16).

That is, when tablet holding portion S2 is positioned on the guide 122, the pressing roller 114 can be prevented from being brought into contact with tablet holding portion S2, and appropriately press tablet holding portion S2 in a state where sheet portion S1 is nipped between the driving rollers 113 and the driven rollers 116 in the sideward direction of tablet holding portion S2. For instance, when the pressing roller 114 is brought into contact with tablet holding portion S2 positioned on the guide 122, PTP sheet S is likely to be jammed, or tablet T is likely to be broken. On the other hand, when the pressing roller 114 presses tablet holding portion S2 at the appropriate position, PTP sheet S is smoothly conveyed and tablet T cannot be broken.

When first interval d1 (=d2) is set to be substantially equal to height h of tablet holding portion S2, after a possibility of breaking tablet T has been eliminated, the distance between the end of the guide 122 and the engaging faces of the driving rollers 113 and the driven rollers 116 can be minimized. That is, since PTP sheet S can be guided until immediately before sheet portion S1 of PTP sheet S reaches the engaging faces of the driving rollers 113 and the driven rollers 116, the tablet dispenser 100 effectively exhibits the conveying stability of PTP sheet S.

The operation and effect of the tablet dispenser 100 and the PTP sheet-guide device 120 of an embodiment of the present invention will be described below.

According to the tablet dispenser 100 (and the PTP sheet-guide device 120) of an embodiment of the present invention, the simple mechanism which moves each guide 122 along the conveying direction can freely change and adjust first interval d1 between the end of the guide 122 and the outer face of each pressing roller 114 according to the thickness of tablet T and/or height h of tablet holding portion S2 of PTP sheet S. The first interval is set to be substantially equal to height h of tablet holding portion S2 (or the thickness of tablet T), so that at conveying PTP sheet S, PTP sheet S can be passed to the engaging faces of the driving rollers 113 and the driven rollers 116 without bringing tablet T into contact with the pressing roller 114 on the guide 122. After tablet T has been prevented from being broken, the guide 122 can be arranged as close as possible to the engaging faces of the driving rollers 113 and the driven rollers 116, thereby being capable of maximizing the conveying stability of PTP sheet S. For instance, in the conventional technique, when the end of the guide 122 and the engaging faces are excessively separated from each other because too much importance is put on the nipping prevention of tablet T, PTP sheet S, which is simply placed on the guide plates, cannot be conveyed without being nipped between the sheet conveying rollers. In particular, this tendency is significant when there is a warp, fold, cut, or the like at the end of sheet portion S1 of PTP sheet S, thereby inhibiting the conveying and dispensing operation from being performed immediately. In the tablet dispenser 100 of this embodiment, first interval d1 can be optimized by the (first and second) interval adjustment mechanisms, and can cope with such problems.

In the tablet dispenser 100 (and the PTP sheet-guide device 120) of an embodiment, when first interval d1 is less than the height of the tablet holding portion (that is, the thickness of the tablet), since second interval d2 between each inhibition portion 128 and each guide 123 corresponds to first interval d1, PTP sheet S can be inhibited from being arranged on the guide 122. That is, each inhibition portion 128 inhibits PTP sheet S which holds tablet holding portion S2 (or tablet T) larger than first interval d1, from being placed on each guide 122, and tablet breakage and sheet jamming can be prevented at arranging PTP sheet S. The moving of each guide 122 in the up/down direction and the turning of each inhibition portion 128 are operated together so that first interval d1 and second interval d2 are substantially matched, so that simply by operating one operation portion 126, both of first interval d1 and second interval d2 can be matched with height h of tablet holding portion S2 of PTP sheet S (or the thickness of tablet T) easily and immediately.

Thus, in the tablet dispenser 100 of this embodiment, tablet T can be prevented from being nipped between each guide 122 and each pressing roller 114 by corresponding appropriately to the type of tablet T, and the PTP sheet can be stably conveyed.

MODIFICATIONS

In the embodiment, the PTP sheet-guide device has the mechanisms which move the moving body 127 in the up/down direction by the rotation of the interval adjustment shaft 125, but the present invention is not limited to this. For instance, the PTP sheet-guide device of the present invention may have mechanisms which use transmission means, such as a gear, to shift each guide and each inhibition portion, thereby adjusting the first interval and the second interval. That is, various interval adjustment mechanisms which can be contrived by those skilled in the art under the technical idea of the present invention can be adopted. In another embodiment of the tablet dispenser and the PTP sheet-guide device of the present invention, the width adjustment mechanism can be eliminated, or other additional functions can also be added.

In the above embodiment, the first interval adjustment mechanism and the second interval adjustment mechanism are substantially integrally formed and are operated together, but the first interval adjustment mechanism and the second interval adjustment mechanism can be operated individually to adjust first interval d1 and second interval d2 independently. Alternatively, the PTP sheet-guide device may eliminate the second interval adjustment mechanism and adjust only first interval d1.

Figure 17:
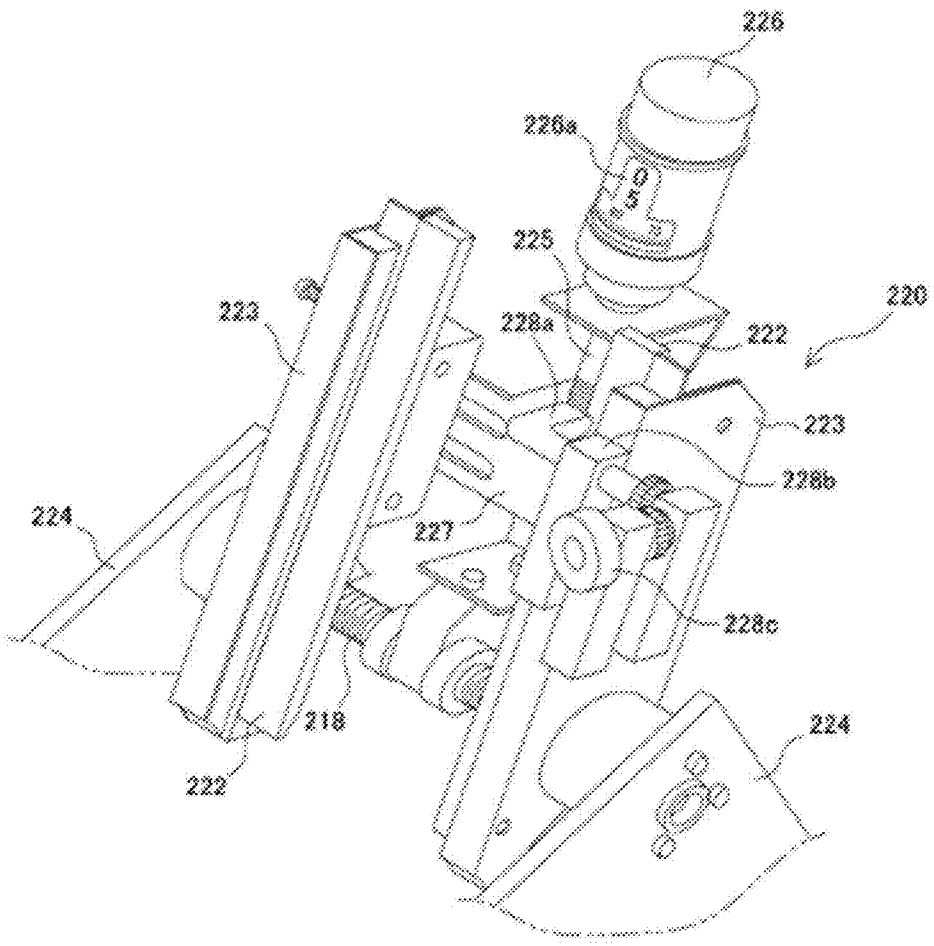
FIG. 17 is a perspective view of a PTP sheet-guide device of another embodiment of the present invention.

For instance, a PTP sheet-guide device 220 in FIG. 17 is the same as the above embodiment, for the mechanism which moves each guide 222 in the up/down direction, and the guide 222 are moved in the up/down direction along an interval adjustment mechanism 225 by the rotation of an operation portion 226 together with a moving body 227. However, in this modification, the moving of the guide 222 (the moving body 227) in the up/down direction and the turning of an inhibition portion 228 are not operated together. The inhibition portion 228 of the PTP sheet-guide device 220 has a locking piece 228*a* which can inhibit the passing of the tablet holding portion of the PTP sheet, a fixed portion 228*b* which is fixed (unrotatably) to one of sideward guides 223, and a second operation portion 228*c* which can turn the locking piece 228*a* through a gear. By rotating the second operation portion 228*c*, the gear transmits the rotation to turn the locking piece 228*a*, thereby being capable of adjusting second interval d2 between the guide 222 and the inhibition portion 228.

The present invention is not limited to the above embodiments and modifications, and can be embodied in various modes as long as they belong to the technical range of the present invention.

The invention claimed is:

1. A tablet dispenser for dispensing a tablet from a PTP sheet having a sheet portion and a tablet holding portion, the table dispenser comprising:
   - a driving roller which is rotatably mounted on a driving shaft;
   - a driven roller which nips the sheet portion of the PTP sheet in cooperation with the driving roller and is rotated following the driving roller to convey the PTP sheet;
   - a pressing roller which is coaxially rotated with either of the driving roller and the driven roller and is arranged so as to be capable of dispensing the tablet by pressing the tablet holding portion and conveying the PTP sheet; and
   - a PTP sheet-guide device having a guide configured to arrange the PTP sheet thereon and guide conveyance of the PTP sheet,
   - wherein the PTP sheet-guide device has a first interval adjustment mechanism configured to change a first interval between an end of the guide and an outer face of the pressing roller, and
   - wherein the PTP sheet-guide device further comprises a second interval adjustment mechanism configured to inhibit the PTP sheet from being arranged on the guide according to the height of the tablet holding portion, the second interval adjustment mechanism having an inhibition portion which extends opposite the guide, being capable of adjusting a second interval between the inhibition portion and the guide, and inhibiting the PTP sheet from being arranged on the guide by abutting the inhibition portion onto the tablet holding portion when the second interval is less than the height of the tablet holding portion.

2. The tablet dispenser according to claim 1, wherein the first interval adjustment mechanism can adjust the first interval by moving the guide along the conveying direction of the PTP sheet.

3. The tablet dispenser according to claim 1, wherein the first interval adjustment mechanism and the second interval adjustment mechanism are operated together so that the first interval and the second interval are matched.

4. The tablet dispenser according to claim 1,
   - wherein the PTP sheet-guide device has a pair of sideward guides,
   - wherein the width of the sideward guides and the widthwise positions of the driving roller, the driven roller, and the pressing roller can be adjusted at the same time so as to correspond to the width of the PTP sheet and the position of the tablet holding portion.

5. A PTP sheet-guide device mounted on a tablet dispenser body having a driving roller rotatably mounted on a driving shaft, a driven roller which nips a sheet portion of a PTP sheet in cooperation with the driving roller and is rotated following the driving roller to convey the PTP sheet, and a pressing roller which is coaxially rotated with either of the driving roller and the driven roller and is arranged so as to be capable of B dispensing a tablet by pressing a tablet holding portion of the PTP sheet and conveying the PTP sheet, the PTP sheet-guide device comprising:
   - a guide configured to arrange the PTP sheet thereon and guide conveyance of the PTP sheet to the engaging faces of the driving roller and the driven roller; and
   - a first interval adjustment mechanism configured to change a first interval between an end of the guide and an outer face of the pressing roller, and further comprising a second interval adjustment mechanism configured to inhibit the PTP sheet from being arranged on the guide according to the height of the tablet holding portion, the second interval adjustment mechanism having an inhibition portion which extends opposite the guide, being capable of adjusting a second interval between the inhibition portion and the guide, and inhibiting the PTP sheet from being arranged on the guide by abutting the inhibition portion onto the tablet holding portion when the second interval is less than the height of the tablet holding portion.

6. The PTP sheet-guide device according to claim 5, wherein the first interval adjustment mechanism can adjust the first interval by moving the guide along the conveying direction of the PTP sheet.

7. The PTP sheet-guide device according to claim 5, wherein the first interval adjustment mechanism and the second interval adjustment mechanism are operated together so that the first interval and the second interval are substantially matched.

8. The PTP sheet-guide device according to claim 5, further comprising a displaying portion which numerically displays the first interval.

* * * * *